United States Patent [19]

Kulp et al.

[11] Patent Number: 4,710,053

[45] Date of Patent: Dec. 1, 1987

[54] TRAFFIC CONTROL ELEMENTS

[75] Inventors: Jack H. Kulp, San Juan Capistrano; Richard M. Cunningham, Huntington Beach, both of Calif.

[73] Assignee: Lukens General Industries, Inc., St. Louis, Mo.

[21] Appl. No.: 615,878

[22] Filed: May 30, 1984

Related U.S. Application Data

[63] Continuation-in-part of Ser. No. 464,025, Feb. 4, 1983, Pat. No. 4,475,101, which is a continuation-in-part of Ser. No. 447,616, Dec. 7, 1982, abandoned.

[51] Int. Cl.[4] ..... E01F 9/00

[52] U.S. Cl. ..... 404/9; 404/6; 340/114 B; 116/63 P; 40/612

[58] Field of Search ..... 404/6, 9, 10; 248/548; 340/114 R, 114 B; 40/606, 610, 612; 116/63 R, 63 P, 63 C, 63 T, DIG. 16

[56] References Cited

U.S. PATENT DOCUMENTS

| | | | |
|---|---|---|---|
| 2,762,327 | 9/1956 | Weig | 340/114 B |
| 2,808,803 | 10/1957 | Weig | 40/612 X |
| 3,916,816 | 11/1975 | Fitch | 116/63 P |
| 3,952,690 | 4/1976 | Rizzo et al. | 116/63 C X |
| 4,083,033 | 4/1978 | Kulp et al. | 340/114 |
| 4,279,105 | 7/1981 | Cameron | 404/6 X |
| 4,289,419 | 9/1981 | Young et al. | 404/6 |
| 4,317,617 | 3/1982 | Charlton | 350/97 |
| 4,475,101 | 10/1984 | Kulp et al. | 248/548 X |

FOREIGN PATENT DOCUMENTS

| | | | |
|---|---|---|---|
| 2122239 | 1/1984 | United Kingdom | 116/63 C |

OTHER PUBLICATIONS

Commercial literature of Flex-O-Lite division of Lukens General Industries, Inc. publicly distributed, 3/14–17, 1984 (2 pages).

*Primary Examiner*—Stephen J. Novosad
*Assistant Examiner*—John F. Letchford
*Attorney, Agent, or Firm*—Cohn, Powell & Hind

[57] ABSTRACT

A traffic control device constructed as either a one piece or two piece device of a resilient plastic by molding. Both the one piece and two piece devices are constructed to have a ground engaging surface defined with a multiplicity of dependent elements arranged thereon in a preselected pattern for distributing the weight of any ballast means over the dependent elements so that they function as localized pressure points to more firmly engage the supporting surface to minimize their movement on the supporting surface due to wind gusts, vibrations or the like.

The two piece device is constructed with a base element that not only includes the dependent elements but also skids for permitting the assembled two piece device to be slid over a supporting surface on the skids to prevent the assembled two pieces from becoming unintentionally detached while being slid.

The devices are capable of being stacked with and without the warning light secured thereto and present the appearance of a formidable object.

37 Claims, 20 Drawing Figures

FIG. 1.
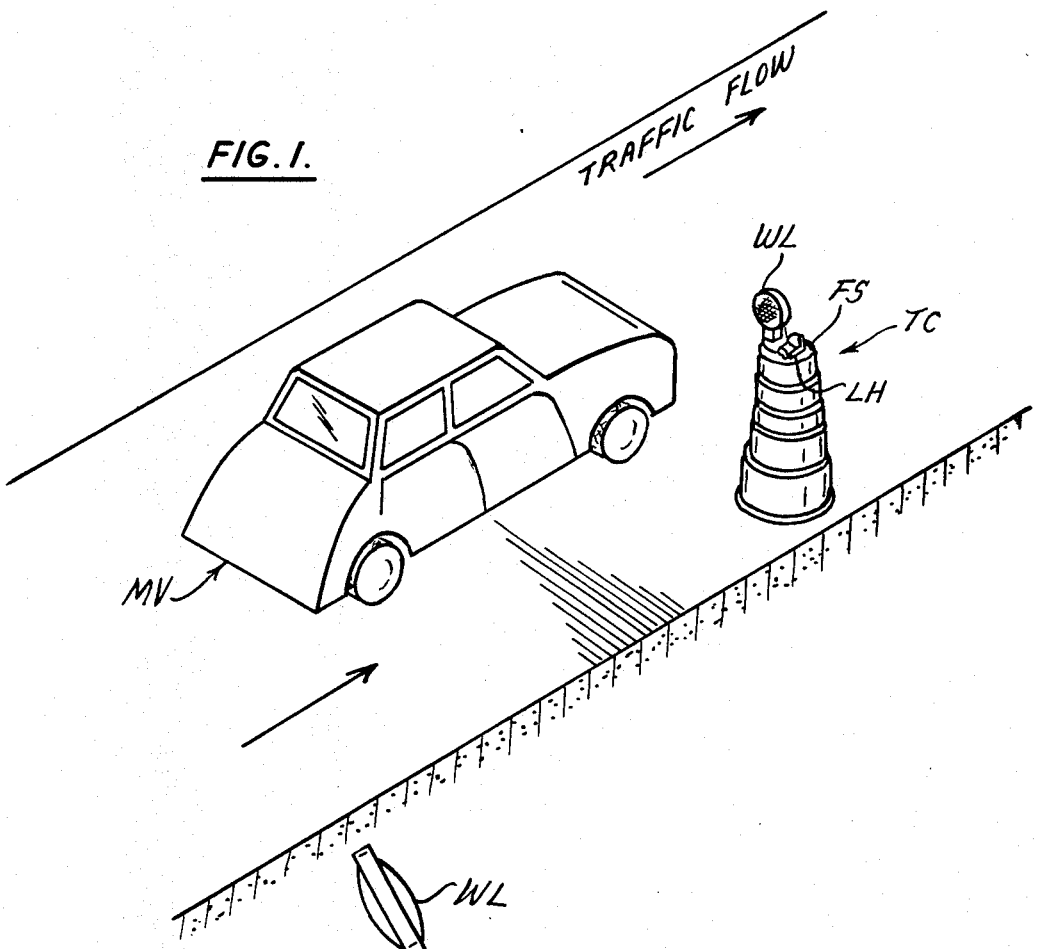
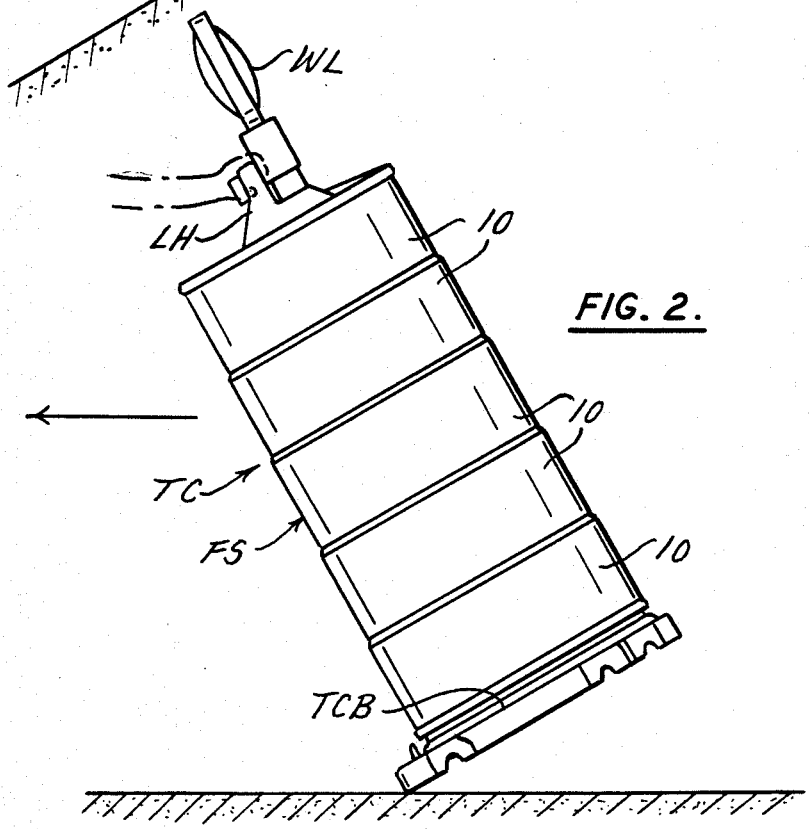
FIG. 2.

FIG. 12.
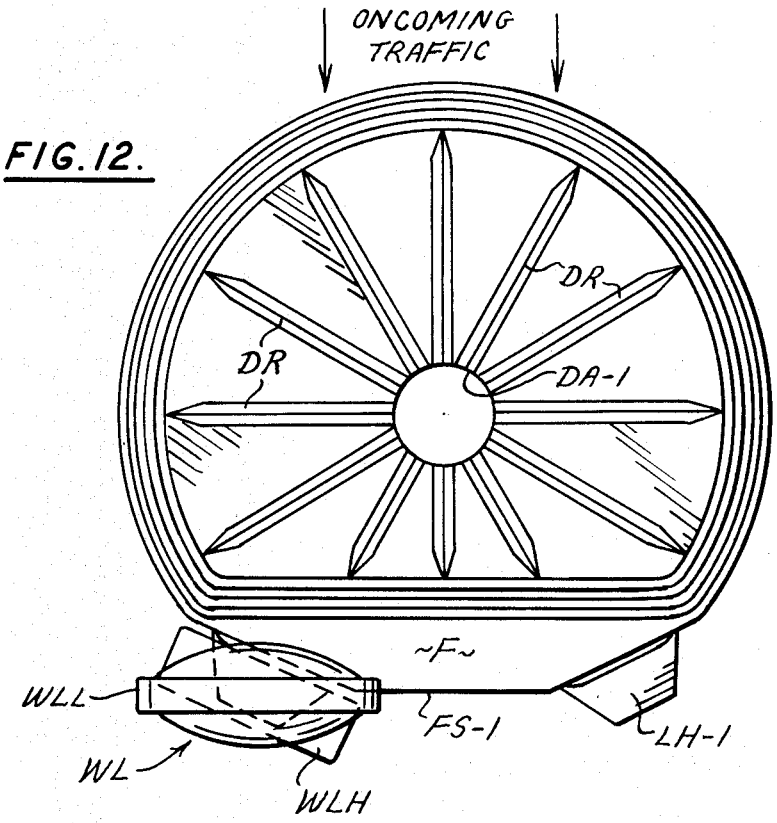
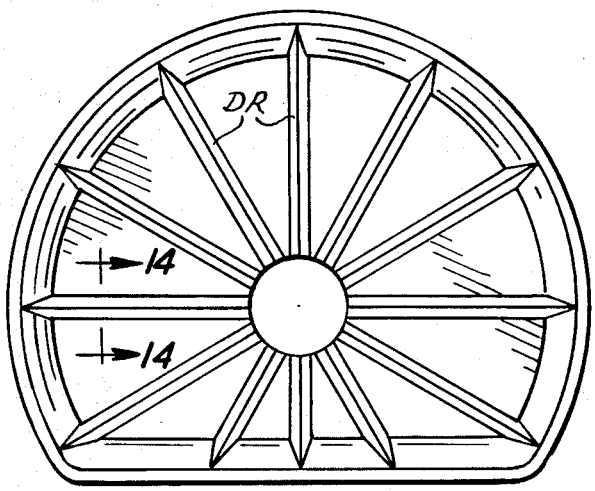
FIG. 13.
FIG. 16.
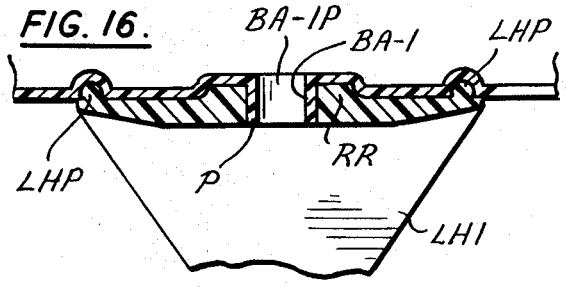
FIG. 14.
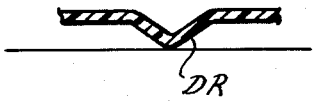

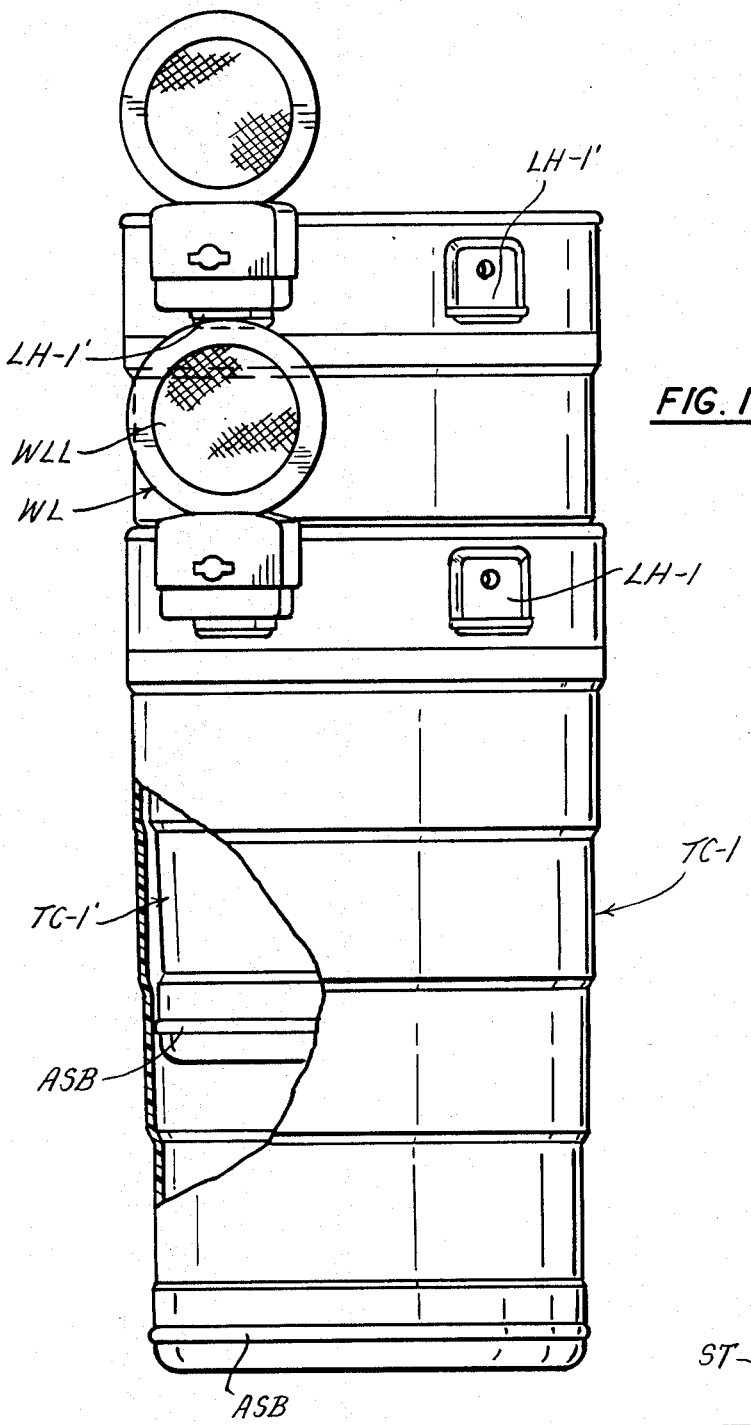
FIG. 18.
FIG. 19.
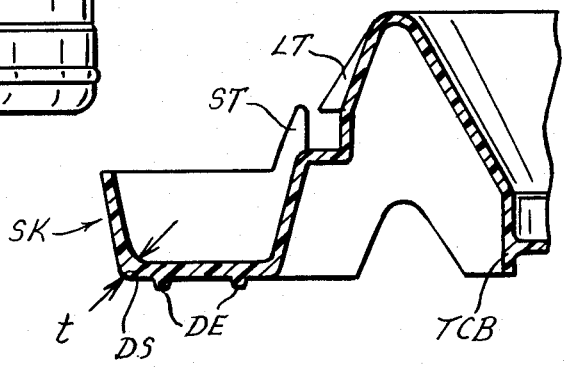

TRAFFIC CONTROL ELEMENTS

This application is a continuation-in-part of our copending application bearing Ser. No. 464,025 filed on Feb. 4, 1983, entitled "Traffic Control Device" and which application now U.S. Pat. No. 4,475,101 granted on Oct. 2, 1984, in turn, is a continuation in part of a copending application bearing Ser. No. 447,616 filed Dec. 7, 1982 and entitled "Traffic Control Device", now abandoned. All of the aforementioned applications are assigned to the same assignee as the present application.

FIELD OF INVENTION

This invention relates to traffic control elements and more particularly to traffic channelization elements constructed as either one or two-piece elements, presenting a formidable object to a motor vehicle operator.

BACKGROUND OF INVENTION

Traffic channelizers are traffic control devices presenting a formidable object to warn an operator of a motor vehicle of a hazard located on the nontraffic side of the channelizer and thereby signal to the motor vehicle operator that he should not proceed into the area beyond the traffic channelizing devices because of a hazard such traffic channelizers usually are approximately 36 inches in height and 18 inches wide to function as a formidbale target to gain the attention of the motor vehicle operator. Metallic drums have been employed for this purpose. Traffic channelizing devices constructed of plastic to avoid the problems of metallic channelizing drums have been developed and are in use. One such plastic channelizer that has been widely utilized is disclosed in U.S. Pat. No. 4,083,033 granted on Apr. 4, 1978 and entitled "Traffic Control Element". One of the embodiments disclosed in U.S. Pat. No. 4,083,033 is a two-piece channelizing element that may be readily assembled together in a stabilized condition for traffic channelization purposes and yet the two pieces may be readily separated upon receiving a substantial impact by a motor vehicle or the like, to minimize damage to the traffic control element and the motor vehicle. In addition to the two-piece, plastic channelizing devices, one-piece plastic devices are presently in use. Present day one-piece devices generally have solid bottoms for storing stabilizing means, such as a sandbag. All of the aformentioned traffic channelizers are adapted to mount a hazard warning light adjacent to the top thereof and are further adapted to be stackable.

Some users of the one-piece plastic channelizers of the prior art have found them to be more convenient in use than a two-piece breakaway device, since some of these devices are provided with an open top that permits the open top to be readily grasped by an individual and allows the channelizing device to be dragged along the ground to a new channelizing or storage position. In addition, some traffic channelizing devices permit the devices to be stacked, with or without the ballast stored therein, without the need to separate the top portion from the base portion for stacking purposes.

Present day plastic channelizers have been subjected to impact testing to determine their response to a substantial impact from the standpoint of the amount of damage caused by the impact, and the amount of displacement of the channelizers from the point of impact. One advantage of a one-piece, ballasted, traffic control device that was determined by the testing is a one-piece traffic channelizing element comes to rest more predictably near its original channelizing position. It was also determined that the point of impact and whether the channelizer had warning lights mounted thereon affects the trajectory and amount of displacement of the device and ultimately the final resting place. These tests further verified that the utilization of one or more flat sides prevented the traffic control devices from rolling beyond the flat side once the energy of impact is dissipated. The disadvantage that was revealed by the aforementioned testing was that the single piece or nonbreakaway type of channelizing device was damaged more extensively with each impact than a two-piece channelizing device. It was also determined that it was more probable that the one-piece device would get tangled with the impacting motor vehicle to a greater extent than the two-piece device and present a danger to the motor vehicle operator.

It has been determined that when a traffic control element or traffic channelizer, either a one or a two-oiece device, is located on a surface, it has a tendency to slide on a supporting surface when a wind gust is suddenly created by a passenger vehicle, truck, or by natural forces. In addition, traffic channelizers utilized on bridge approaches are subject to vibrations caused by the passing motor vehicles, thereby causing them to slide or "walk away" from their desired position.

The aforementioned two-piece traffic control elements are often used to channelize traffic from one traffic lane to another for a "working" period of time. At the end of the work period, the previously closed traffic lane is opened again to traffic while the daily work is stopped. The traffic lane is closed again when the workmen return to complete their assigned tasks. In opening and closing the traffic lanes, by means of a two-piece traffic control element, the element is usually dragged across the open lane of traffic from its traffic control position to a storage location. It is inconvenient, if not dangerous, if the base element of the two-piece channelizer becomes disengaged from the body of the channelizer while a worker is dragging the channelizer across a roadway between moving motor vehicles.

It has also been found that unlike the metal traffic channelizer devices, some motorists will intentionally hit a light weight, plastic channelizing device with the knowledge that no harm will result to their vehicle. The same motorists avoid a channelizer constructed of metal because of the obvious damage that would occur to their vehicle. Some prior art traffic channelizers are constructed and designed with warning lights secured thereto that extend outside the perimeter of the channelizer that is exposed to the traffic. In channelizers of this construction, the motor vehicle operator will drive his vehicle very close to the channelizer, but while missing the channelizer proper, may strike the warning light holder or the warning light mounted thereon causing damage to the channelizer light holders and the warning lights. Accordingly, there is a present need for an improved, plastic, traffic control device that avoids the aforementioned problems of the prior art plastic channelizers whether constructed as a one or two-piece device.

SUMMARY OF INVENTION

The present invention provides an improved, relatively inexpensive, light weight and stackable traffic control element that has the formidable appearance of a metal barrel and yet is constructed and defined of a light weight, resilient, plastic material. The improved traffic control device may be constructed as a one or two-piece device with an improved base or closed end arranged for more firmly engaging the supporting surface through the advantageous provision of a multiplicity of ground engaging dependent elements for the base to distribute the weight of any ballast mounted within the traffic control device for concentrating the weight over the ground engaging elements to cause these elements to locate themselves more firmly in any imperfections in the supporting surface to thereby cause the traffic control devices to be more resistant to slipping and sliding in response to wind gusts, including those created by motor vehicles and to vibrations imparted to the supporting surface and the like. The traffic control devices are advantageously constructed and defined for mounting conventional warning lights thereon so as not to protrude beyond the traffic exposed sides of the traffic control elements, thereby minimizing the possibility of impacts caused by outwardly extending warning lights. Both the one and two-piece traffic control elements are stepped from one end to the opposite end to permit them to be more readily stacked, either with or without the warning lights mounted thereon, and yet have an overall appearance that is nearly cylindrical to provide the forbidding appearance of a 55 gallon metal drum. The body of the traffic control devices is designed to permit conventional reflective sheeting to cover its entire outer surface to minimize impact to the motor vehicle, including during the night hours. The traffic control devices are advantageously constructed with improved warning light holders that prevent the warning lights from rotating on the channelizers from their desired signalling position and to minimize the tendency of the warning lights from being torn or ripped off the traffic control devices upon impact between a traffic control device and a motor vehicle.

The improved, two-piece traffic control device is constructed and defined with skid means integral with the base element for permitting the assembled two-piece traffic control element to be slid across a supporting surface without causing the two engaged pieces to become disengaged. The traffic control device can be provided with a handle to allow an individual to tilt the device to place the skid means into engagement with the supporting surface so as to allow the device to be more readily slid over the surface by the skid means while the two pieces are engaged, without the two pieces and any ballast means becoming separated from one another.

From the broad structural standpoint, the traffic control devices of the present invention comprise a hollow element having a preselected outer configuration and a substantially closed end for mounting it in a vertical position with a mounting surface to function as a traffic control element. The traffic control device has a forbidding appearance to a motor vehicle operator, so the operator tends to avoid engagement therewith. The substantially closed end is adapted to receive and store ballast means for stabilizing the hollow element at the preselected traffic controlling position. The outside surface of the closed end of the device is constructed and defined with a slip resistant ground engaging surface whereby the traffic control element engages a mounting surface by means of the slip resistant surface. The slip resistant surface comprises a multiplicity of peaks and valleys that function for distributing the weight of any ballast means over each of the multiplicity of peaks to cause the peaks to function as localized pressure points for better stability on the mounting surface to thereby substantially prevent the sliding of the traffic control element from its desired position on the mounting surface in response to wind gusts, vibrations, or the like.

The improved, two-piece traffic control element comprises a hollow element having a preselected configuration and a base element adapted to be readily assembled and separated from the hollow element. The hollow element is mounted to the base element when it is arranged in the vertical traffic controlling position. The base element is adapted to store ballast means thereon for stabilizing the hollow element when it is arranged in the vertical traffic controlling position. The improvement comprises the base element having skid means for permitting the assembled traffic control element to be slid across a surface on the skid means without causing the hollow element and the base element, and any stored ballast, to become unintentionally separated while being slid.

From a more specific standpoint, the two-piece traffic control element comprises a hollow element having a preselected configuration and a base element adapted to be readily assembled and separated from the hollow element. The hollow element is mounted to the base element when it is arranged in the vertical traffic controlling position. The base element is adapted to store ballast means thereon for stabilizing the assembly of the hollow and base elements. The outside surface of the base element is constructed and defined with a multiplicity of dependent elements arranged in a slip-resistant pattern thereon, whereby the traffic control element engages the mounting surface by means of the dependent elements. The dependent elements function for distributing the weight of any ballast means stored on the base element over each of the multi-plicity of dependent elements to cause the elements to function as localized pressure points to better stabilize the device on the mounting surface. The outside surface of the base element includes skid means arranged thereon adjacent the outer periphery of the base element and spaced from the dependent elements. The skid means are constructed and defined for permitting the assembled, hollow and base elements to be slid across a mounting surface without causing the hollow element, base element and any stabilizing element, to become unintentionally separated while being slid.

BRIEF DESCRIPTION OF DRAWINGS

These and other features of the present invention will be more fully appreciated when considered in the light of the following specification and drawings, in which:

FIG. 1 is a diagrammatic representation of a motor vehicle travelling on a public highway illustrating the traffic control element of the present invention positioned on the highway for channelization purposes;

FIG. 2 is a side elevational view of a two-piece traffic control element arranged in a tilted relationship with the supporting surface for allowing it to be slid by means of the skid means and embodying the present invention;

FIG. 12 is a top plan view of the traffic control element of FIG. 11 with the preferred orientation of the device relative to the oncoming traffic indicated;

FIG. 13 is a simplified, bottom plan view of the traffic control element of FIG. 11;

FIG. 14 is a partial sectional view taken along the line 14—14 of FIG. 13;

FIG. 16 is a partial sectional view taken along the line 16—16 of FIG. 11;

FIG. 18 is an elevational view, with portions broken away, illustrating the stacked relationship of a plurality of the traffic control elements of FIG. 11 with the warning lights mounted thereon; and FIG. 19 is a partial sectional view taken along the line 19—19 of FIG. 7.

DETAILED DESCRIPTION OF THE PREFERRED EMBODIMENTS

Two Piece Traffic Control Element

Now referring to FIGS. 1 through 10, 17 and 19, the preferred embodiment for the two-piece, traffic control element TC of the present invention will be described in detail. The traffic control element TC may be utilized in a variety of fashions for traffic control, signalling and/or channelization, and is illustrated in FIG. 1 as it may be positioned on a highway adjacent the side of a traffic lane for traffic channelization purposes. In a number of applications of the traffic control device TC, a multiplicity of such devices may be arranged in a preselected alignment for traffic channelization, such as when it is desired to signal a hazard in a lane in which a motor vehicle is approaching to cause the motorist to change lanes. The traffic control device TC is preferably constructed and defined to be roll resistant by providing at least one flat side FS for the control device TC so that when the device is impacted to a horizontal position, the channelizer will come to rest on its flat side FS to prevent further movement of the traffic control device TC. Specifically, if a large truck or trailer-truck is moving at a relatively high speed past the control device TC when it is in a horizontal position, the wind created by such high speed movement would not cause the traffic control device TC to respond to the gust of wind, but it would be maintained in its impacted position, as contrasted with a device having a circular configuration, for example, since a circular device will roll.

The traffic control device TC has a preselected configuration to appear as a formidable object, such as a metallic cylinder. The preselected configuration is approximately 36 inches in height and 18 inches wide.

The traffic control device TC illustrated in FIG. 1 is shown mounting a warning light WL upon the top of the traffic control element TC. The traffic control element TC is constructed and defined to mount a pair of warning lights WL, side-by-side, on the top portion thereof. As illustrated in FIG. 1, the warning light WL is mounted to the traffic control element TC adjacent the traffic side of the roadway to draw attention to a hazard (not shown) located on the non-traffic side of the traffic control element TC. The warning lights WL are commercially available warning lights and are known in the art as a type A or C barricade light and are commercially available from the Signal Division of Lear Siegler, Inc., 1370 Esperanza St., Los Angeles, Calif. The warning light WL may be a steady burn light, type C, or a flashing light, type A, in accordance with the particular application and requirements of the governmental entity having jurisdiction over the road, highway or freeway. Only one light WL is mounted to the traffic control device TC under most circumstances. In many applications of the traffic control element TC, the lights may be omitted in their entirety.

Figure 3:
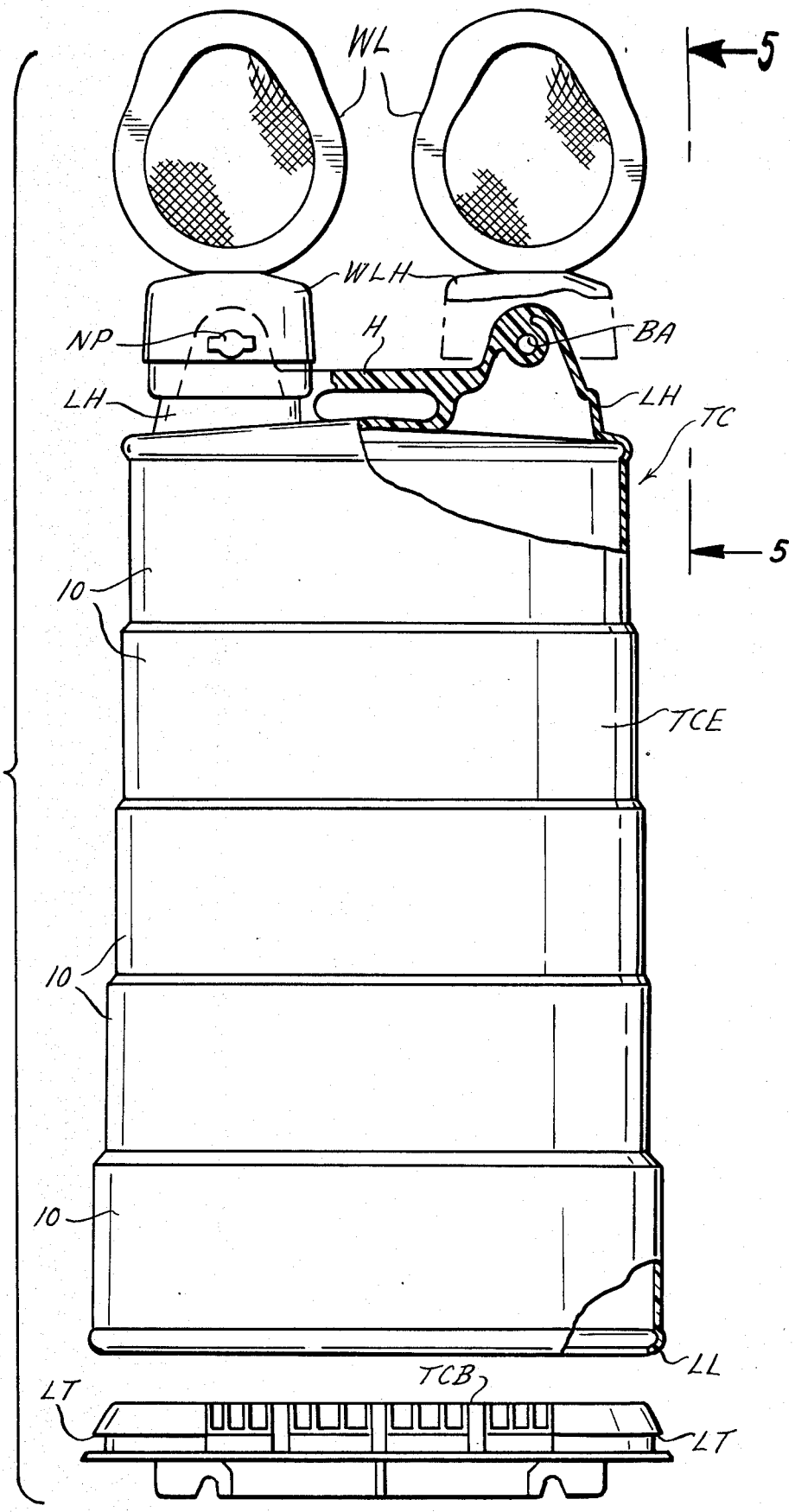
FIG. 3 is an exploded view, with portions shown in section, of the two-piece traffic control element of FIG. 1 showing the two pieces in a detached relationship and with a pair of warning lights secured thereto.

The traffic control element TC has the overall configuration of a cylindrical steel barrel and therefore is adaptable to be used for the same general purposes as the present day traffic channelizers of the type disclosed in U.S. Pat. No. 4,083,033 and may be used with the additional advantages and features described herein which are not comprehended by prior art traffic control elements. The general configuration of the traffic control device TC for the purposes of the present invention is that it preferably has an arcuate configuration approaching that of a cylinder (to appear similar to a cylindrical metal drum) that has at least one flat side FS to prevent it from rolling as mentioned hereinabove. The illustrated configuration is D-shaped in cross-section. The configuration is further defined to have a stepped configuration between its ends with the larger end normally resting on a supporting surface. The free end, or the smaller end, of the device TC is adapted to mount a pair of warning lights WL in the pair of light holders LH constructed integrally therewith. The stepped configuration is defined to provide a plurality of arcuate sections 10 defined on the outer surface of the traffic control element TC of successively decreasing diameter from the top end to the bottom end, as illustrated in FIG. 3. The arcuate sections 10 may be provided with surface areas that contrast in color with the basic color of the traffic control element TC proper. The contrasting color may be provided by means of commercially available reflective sheeting secured to the treated outer surfaces of the traffic control element TC by adhesives or the like. The commercially available sheeting secured to the control element TC may also include reflective properties for nighttime use and the refelective sections may be arranged in a spaced apart relationship thereon or to cover all of the outer surfaces of the arcuate sections 10 for the traffic control element TC. The reflective sheeting is not illustrated in the drawings.

The traffic control element TC is illustrated in FIG. 3 in an exploded relationship for showing the two pieces of the traffic control element TC and their interrelationship. The two pieces that comprise the traffic control element TC are the traffic channelization body TCE and the base element TCB. The two elements of the traffic control device TC are constructed and defined to be readily assembled into a one-piece unit for defining the traffic control element TC. The two pieces TCE and TCB are also readily disengaged from one another, such as when the channelizer is subjected to an impact in accordance with the structures of present day channelizers, such as disclosed in U.S. Pat. No. 4,083,033.

Figure 4:
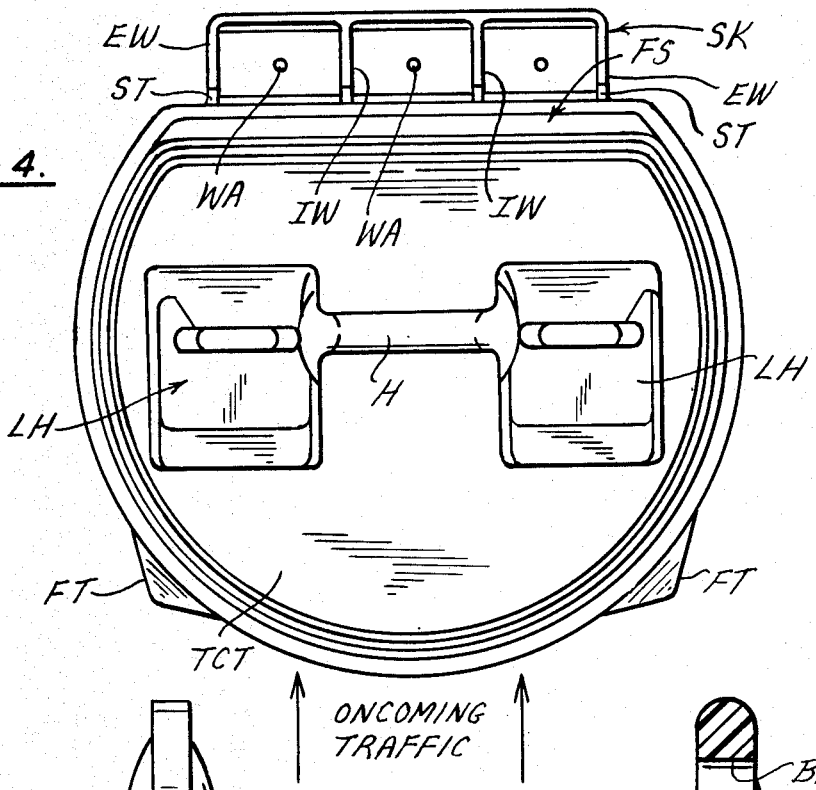
FIG. 4 is a top plan view of the traffic control element of FIG. 3 with the warning lights detached therefrom and with the preferred orientation of the device relative to the oncoming traffic indicated.
Figure 5:
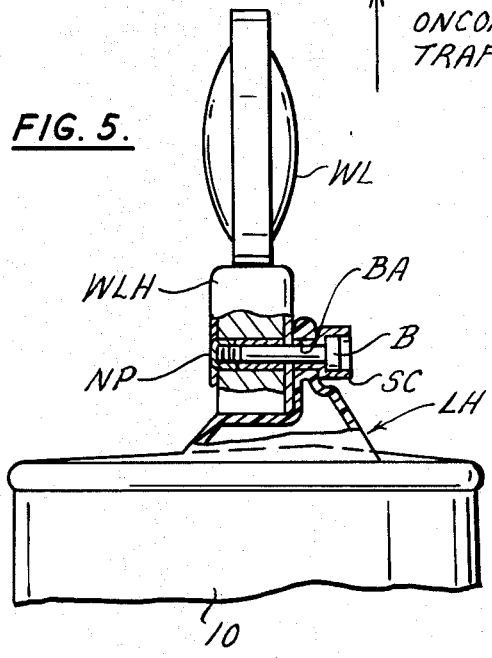
FIG. 5 is a view taken along the line 5—5 of FIG. 3 with portions illustrated in section.
Figure 5A:
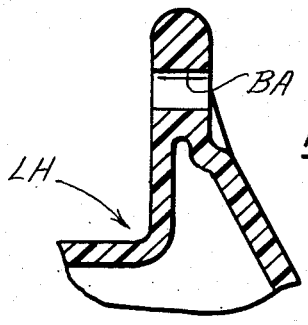
FIG. 5a is a partial sectional view of the light holder of FIG. 5.

The body element of the channelizer TCE is of a stepped configuration, as illustrated, with the larger end of the element TCE being adpated to be releasably interlocked with the base element TCB. The body element TCE is a hollow element with a closed top end and an open bottom end. The bottom end of the element TCE is provided with a locking lip LL defined around the periphery thereof and which locking lip LL is defined to extend inwardly from the outer wall of the element TCE for engaging a coacting locking element defined on the base element TCB, as will be described hereinafter. The closed top end TCT for the element TCE is constructed and defined with a pair of integral light holders LH arranged in a spaced apart relationship within the outer periphery of the channelizing body TCE and positioned adjacent the periphery but on opposite sides of the element TCE. Each light holder LH is defined as a substantially L-shaped configuration for defining a shelf for receiving and mounting the warning light housing WLH thereon and to be secured to the holder LH by a securing bolt B in a nonrotatable relationship therewith. Specifically, each light holder LH is defined by an upstanding portion molded integrally with the top end TCT to provide a platform in a horizontal plane for mounting the housing WLH of the warning light WL thereon. The platform may be considered the horizontal arm of the L-shaped light holder LH. The upstanding arm of the L-shaped holder LH extends in a vertical plane from the platform to accept a vertical wall of the housing WLH for the light WL, as best illustrated in FIG. 5. The upstanding arm is provided with a bolt aperture BA for receiving the warning light mounting bolt B. As best illustrated in FIG. 5A, the upstanding arm of the light holder LH is constructed to be solid throughout around the bolt aperture BA. The light holder LH then not only maintains the warning light in a nonrotatable position but also minimizes the tendency of the bolt B ripping out when when the channelizer TC is impacted by a motor vehicle. Handle means H to facilitate moving the device TC is also defined on the top of the body TCE. In this instance, the handle means H is constructed integral with the light holders LH and extends between the two light holders; see FIGS. 3 and 4. The handle means H is formed by molding it as a solid plastic element spaced above the top surface TCT a preselected distance sufficient to allow an individual's hand to grip the handle to facilitate movement of the element TC. The handle means H has its opposite ends molded integral with the light holders LH and to extend therebetween.

The commercially available warning light WL is normally provided with a retainer bolt to allow it to be mounted and secured to a barricade. The same warning light mounting bolt is used for the purposes of mounting the warning light to the traffic control element TC at the light holders LH. The warning lights WL are preferably secured to the light holders LH in an anti-theft relationship. The warning light housing WLH accepts the securing bolt B and which bolt B is secured to the nut plate NP normally provided with the housing to permit the housing to be secured to the light holder LH when the bolt B is inserted through the aperture BA provided for the light holder LH. The bolt B is threadedly secured into the nut plate NP to secure the warning light to the light holder. A security cup SC is generally provided for securing the bolt B to the warning light so as to provide an anti-theft relationship. The security cup SC is secured to the secured bolt B on the opposite side of the light holder LH from the warning light WL, as illustrated in FIG. 5. The security cup SC has a central opening at the closed end of the cup to receive the shank of the bolt B. When the cup SC is mounted to the bolt shank B in an orientation so that the open end of the cup SC would be extended over and beyond the bolt head for the bolt B, the cup aperture is aligned adjacent the outside surface of the bolt head B. In this fashion, the cup SC prevents access to the bolt head by conventional tools and thereby prevents the warning light WL from being readily removed from the traffic control element 10 by unauthorized individuals. The bolt head B for anti-theft purposes may have a special configuration to accept the special wrench to allow only authorized individuals to release the bolt B from the warning light housing WLH when secured as illustrated in FIG. 5. A typical arrangement of the bolt head and securing cup and the special wrench that is applicable to the present invention is described and illustrated in FIGS. 5, 9, and 10, of the U.S. Pat. No. 4,083,033.

Figure 17:
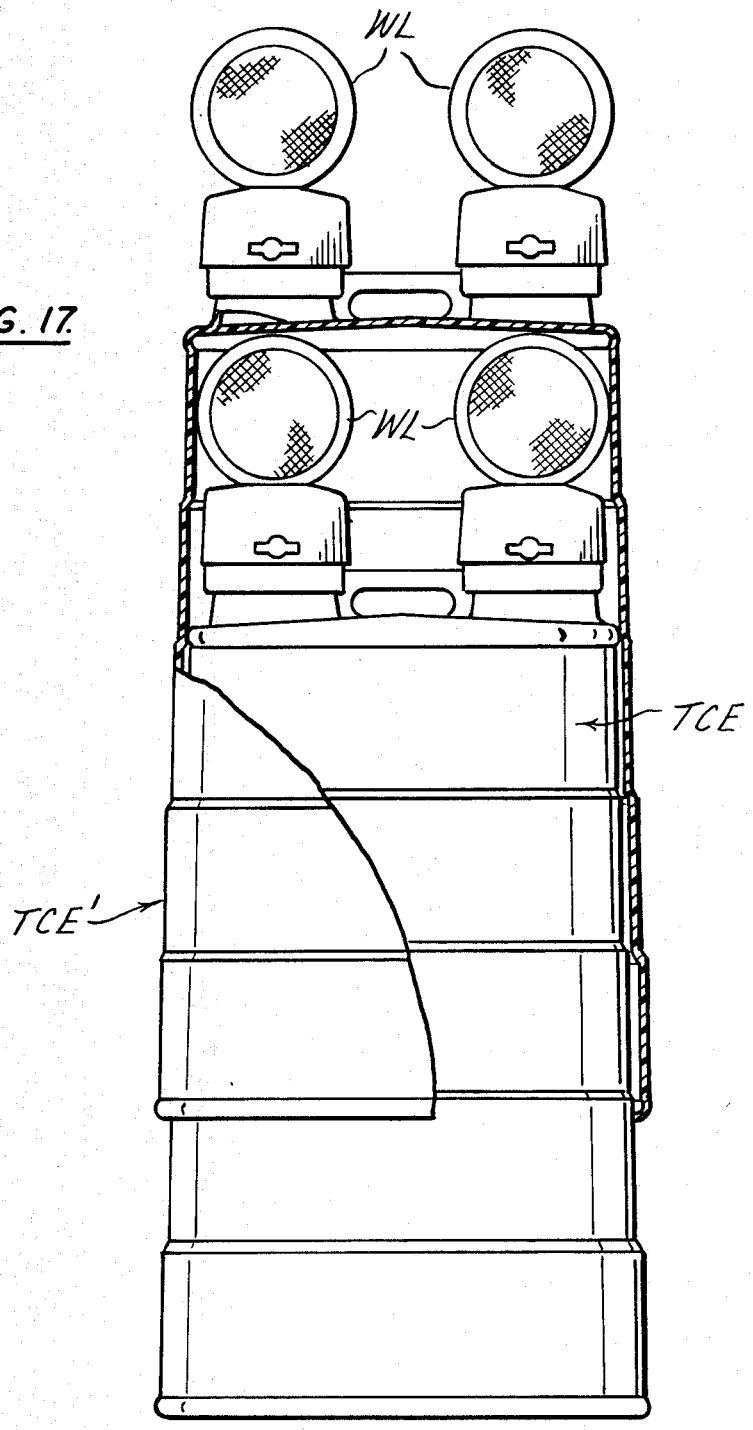
FIG. 17 is an elevational view, with portions broken away, illustrating the stacked relationship of a plurality of the traffic control devices of FIG. 3 with the bases detached and the warning lights mounted thereon.

When the two pieces TCE and TCB of the traffic control element TC are assembled for use on a traffic lane, the warning light WL is usually mounted on the light holder LH which is adjacent the flow of traffic as diagramatically illustrated in FIG. 1. This is to provide the most light to the oncoming motorists for warning and signalling ourposes. In the event that the traffic control element TC is positioned between lanes of traffic for signalling a hazardous condition between the lanes, a warning light WL would be secured to each of the light holders LH such as illustrated in FIGS. 3 and 17. In any event, the preferred orientation of the traffic control element TC is such that the cylindrical or arcuate portion of the element TCE is mounted to face the oncoming traffic so that the flat side FS is away from the oncoming traffic. This relationship with the oncoming traffic is indicated by the legend in FIG. 4. In this manner, the portion of the traffic control element TC that is visible to the approaching traffic appears to have the configuration of a metal traffic channelizing drum and appears as a more formidable object, in view of the slight taper designed into the device and yet permit the device to be stacked, unlike metal drums.

An important feature of the traffic control elements of the present invention is the construction of the surface engaging portions of the bottoms of both the one and two piece channelizers to prevent the unintentional movement of the channelizers from their desired location in response to natural wind gusts and those created by motor vehicles or by vibrations imparted to the supporting surface. The preferred embodiments of both of the channelizers of the present invention have their ground engaging surfaces defined as slide resistant surfaces by the provision of a multiplicity of dependent elements arranged thereon to function as localized pressure points over which the weight of any ballast for the channelizers is distributed. The individual dependent elements engage imperfections in the mounting or road surfaces to cause the traffic channelizing devices to resist sliding movement due to wind gusts, vibrations, etc. By distributing the weight of a conventional ballast over a multiplicity of dependent elements engagable with the supporting surface the contact area for the base is substantially decreased relative to a base having a flat, smooth bottom. Although it is difficult to calculate the exact surface contact areas for the one and two piece channelizers, the contact areas in accordance with the present invention have an increase in unit pressure of between six to seven times that of smooth, flat bottom areas.

It should be understood that although the ground engaging surfaces of the channelizers of the present invention are described in terms of dependent elements that are defined in regular patterns as the preferred embodiments, the dependent elements may be formed in an irregular or random pattern in accordance with the teachings of the present invention. To this end the ground engaging surfaces may be defined by a rough textured surface having peaks and valleys to prevent the unintentional movement of the channelizers. Such a rough texture may be produced by sandblasting or texturing the ground engaging surfaces of the channelizers, for example. Other similar techniques for providing a slide resistant ground engaging surface may be resorted to other than the specific patterns of dependent elements described herein.

Figure 8:
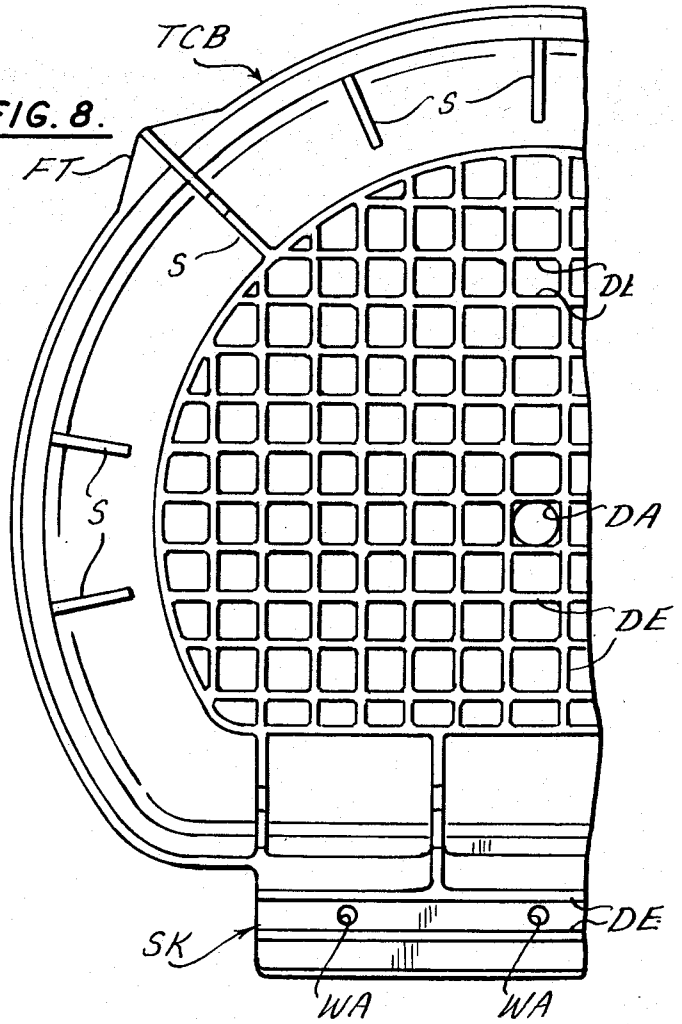
FIG. 8 is a partial bottom plan view of the base element illustrated in FIG. 7.
Figure 7:
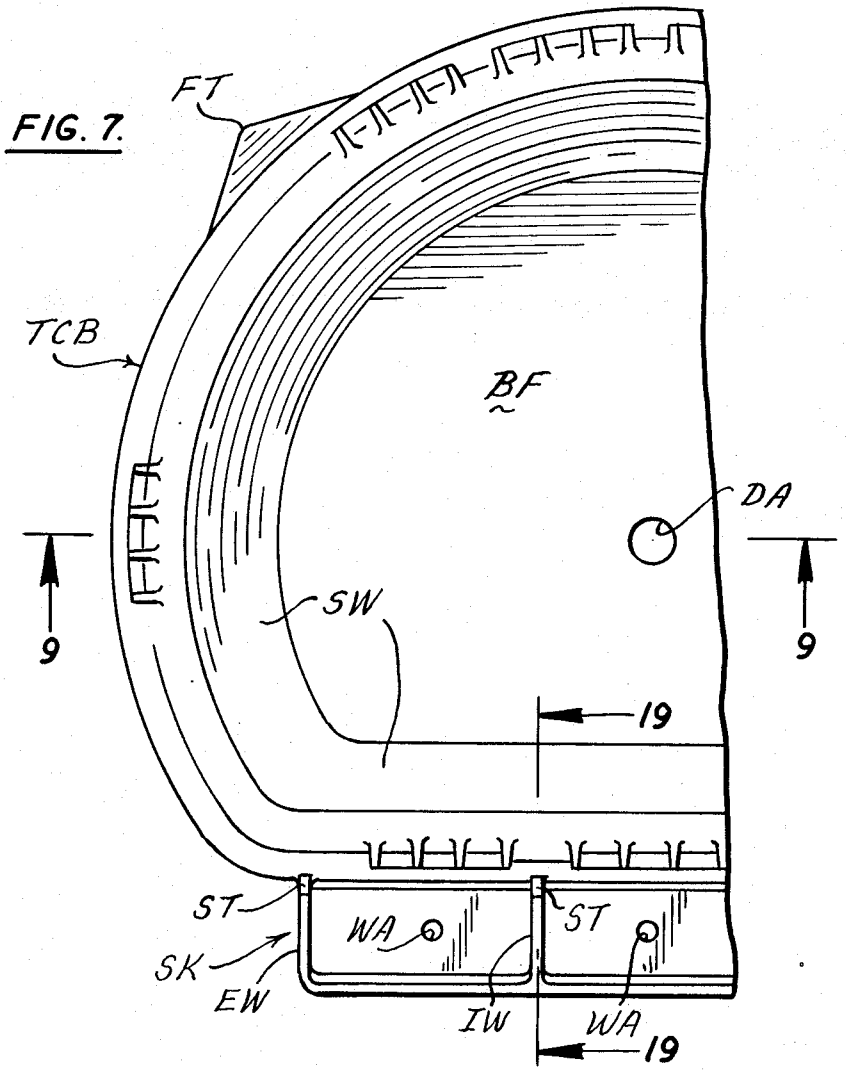
FIG. 7 is a partial top plan view of the detached base element for the channelizer of FIG. 3.

With particular reference to the base elements TCB for the two piece element TC, the dependent elements are defined by a waffle-like pattern of elements molded integrally with the element TCB. The waffle-like pattern covers the central surface engaging portion of the bottom of the element TCB. The waffle-like pattern, as illustrated in FIG. 8, comprises a multiplicity of squares with each of the side walls of the squares defined in the same horizontal plane so that the free ends thereof engage the road surface. These elements are identified as the elements DE and their relationship to the supporting surface is best appreciated from examining FIGS. 6, 9, and 19.

Referring to FIGS. 3, 6–9, and 19, the construction of the base element TCB will be further described. As in the prior art traffic control elements constructed as two piece elements, the base element TCB is constructed and defined to be readily attached and detached with the body portion TCE of the element TC by means of the locking lip LL. For this purpose the base element TCB is provided with a plurality of spaced locking tabs LT that protrude outwardly therefrom to cause the locking lips LL to be snap locked thereto when the element TCE is mounted over the base element TCB and pressure is applied thereto to cause the locking lip to snap under the tabs LT to releasably lock the two elements together; see FIG. 6. When locked together in this fashion, and the element TC is impacted by a motor vehicle, a substantial impact causes the disengagement of the locking lip LL and locking tab LT to allow the element TCE to absorb the impact energy by being displaced from the base element TCB, as is now conventional.

The base element TCB is provided with a drain aperture DA to permit any water accumulating thereon to drain through the aperture DA onto the supporting surface.

Figure 6:
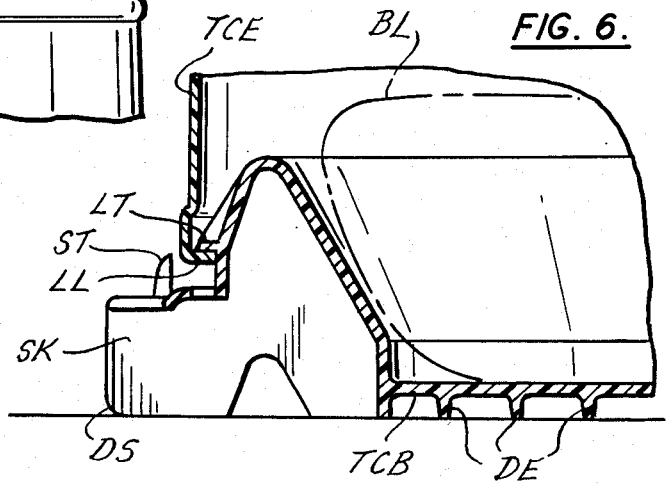
FIG. 6 is a partial cross sectional view of the attached base and body elements for the channelizer of FIG. 3 with the ballast means illustrated in dotted outline as it is stored on the base element.
Figure 9:
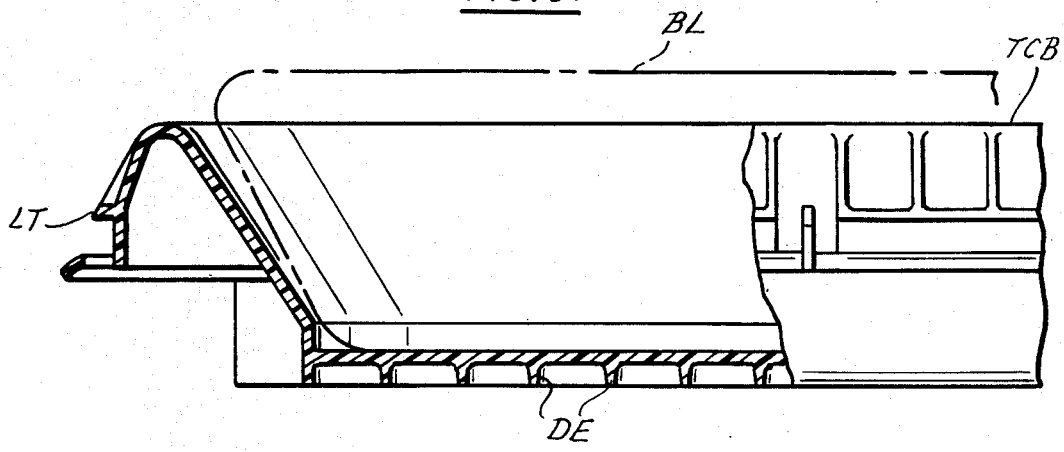
FIG. 9 is a view taken along the line 9—9 of FIG. 7 with portions broken away and with the stored ballast means illustrated in dotted outline.

The inside surface of the base element TCB has a flat surface BF on the opposite side of the area from the waffle pattern on the bottom. The side walls SW of the top side of element TCB are inclined inwardly to define the outer perimeter of the flat side BF. This flat side BF can be considered as a storage tray upon which any ballast means BL may be stored. The ballast means conventionally comprises a sand bag and is illustrated in FIGS. 6 and 9 in dotted outline.

In addition to the dependent elements DE, the bottom of the base element TCB is further modified in accordance with the present invention to provide skid means SK that allows the assembled channelizer TC to be slid or dragged over a road surface without unintentionally detaching the base element TCB from the body portion TCE, including when the ballast means BL is stored within the base element. The skid means SK comprises a U-shaped trough constructed integrally with the base element TCB and coextensive with the flat side FS thereof; see FIGS. 4, 6–8, and 19. The U-shaped trough as molded has both ends closed by end walls EW and a plurality of compartments defined by the internal walls IW arranged intermediate the end walls EW. Two internal walls IW are illustrated in FIG. 4 arranged in spaced apart relationship for defining three hollow compartments of the same size. The end walls EW and the internal walls IW are provided for stiffening the thus defined skid means SK. Each compartment of the skid means is provided with an aperture WA to permit any water accumulating therein to drain therefrom. The bottom outer surface DS (see FIG. 19) of the U-shaped trough is constructed and defined as a curved skidding surface to function as a skid or runner to permit the assembled channelizer TC to be slid or dragged thereon. For this purpose the thickness T of the outer surface is increased from that of the bottom and side walls of the trough so that in use the surface DS will not be readily ground away as a result of the dragging of the channelizer TC thereon. The skid element SK, then, permits the assembled traffic control element TC to be slid over the surface of the road on the bearing surface provided at surface DS for the skid element SK when the assembled element TC is tilted to place the surface DS in engagement with the road surface in the manner illustrated in FIG. 2. For this purpose, an individual will grasp the handle H and tilt the traffic control element TC to tilt the element forwardly toward himself until the arcuate surface DS of the skid element SK engages the road surface. This allows the assembled element to be readily slid along the roadway without the two pieces of the traffic control element TC becoming unintentionally separated.

It has been found that when the element TC is dragged as described hereinabove the ballast BL in the form of a sandbag, for example, may fall against the flat side of the base element TCB when the element TC is dragged. This redistribution of the weight of the ballast BL may cause the interlocked elements LT and LL to come apart during the dragging operations. To prevent this unintentional separation of the base element TCB and the traffic channelization body TCE, the base element is provided with a plurality (four) of security tabs ST provided for the skid element SK and extending upwardly from each of the walls EW and IW a sufficient distance to keep the locking lip LL and locking tab LT interlocked to prevent the unintentional detachment of these two elements when the element TC is dragged in a tilted relationship; see FIGS. 6 and 19.

The bottom surface of the skid element SK is also provided with a slip resistant surface in the form of the parallel, spaced apart dependent elements DE; see FIGS. 8 and 19. The dependent elements DE for the skid element SK are illustrated in the form of two spaced ribs longitudinally extending from the bottom surface of the element SK.

The skid element SK is also defined in accordance with the present invention for extending the base element TCB outwardly to further stabilize the assembled channelizer. The extent of the extension of the element SK from the flat side FS of element TCB has been selected to render the assembled element TC more resistant to being blown over due to the various wind gusts it may be subject to. A series of stiffeners S are spaced on the back side of element TCB between the pattern of dependent elements DE and the outer periphery of the base element TCB; see FIG. 8. The base element TCB also includes a plurality of foot tabs FT arranged in a spaced relationship and extending outwardly of the arcuate portion of the base element TCB. Two such foot tabs FT are illustrated in FIG. 4. The foot tabs FT are shown in the form of triangular tabs extending outwardly from the outer periphery of the element TCB. The stiffeners S under the foot tabs FT are extended to the outer periphery of the waffle pattern of elements DE, as illustrated. The foot tabs FT are provided to allow an individual to place a foot on a tab or tabs FT for releasing the locking lip LL from the locking tab LT when the two pieces are to be disengaged by pulling them apart.

A further practical feature of the base element TCB is the provision of the stacking notch SN arranged inwardly of the dragging surface DS; see FIG. 6. This stacking notch SN permits the base elements TCB to be stacked closer together than if the notch was not provided.

Figure 10:
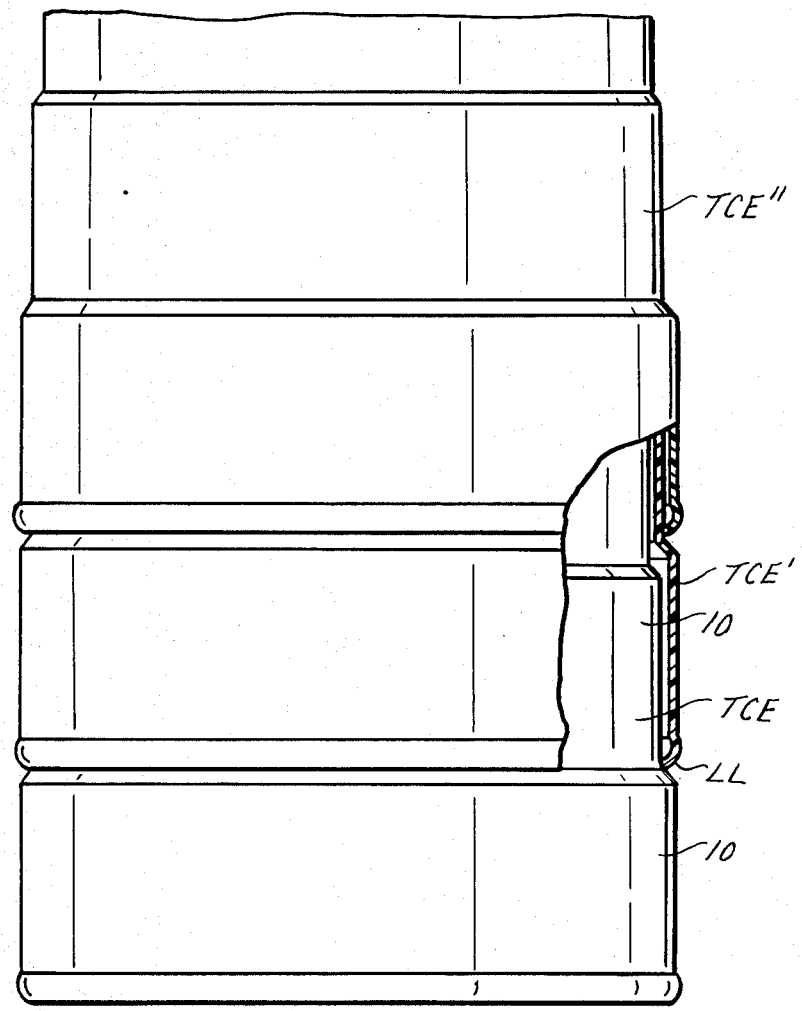
FIG. 10 is an elevational view, with portions broken away, to illustrate the stacked relationship of the body portions of the traffic control element of FIG. 3, but without the warning lights secured thereto.

The stacking of the traffic control elements TCE without the warning lights WL mounted thereon is illustrated in FIG. 10. In order to stack the elements TCE, the base elements TCB must be detached. It will be seen that three traffic control elements, TCE, TCE' and TCE", are stacked in a nesting relationship, as illustrated in FIG. 10. The bottom element TCE receives the second traffic control element TCE' and stacks over the bottom element TCE down to the last arcuate section 10. Similarly, a third traffic control element TCE" is nested over the elements TCE and TCE' and the bottom arcuate section 10" for the element TCE" comes to rest at the bottom arcuate surface 10' for the element TCE'. When the warning lights WL are maintained in a mounted secured position on their mounted position on the elements TCE, the traffic control elements TCE can still be stacked with the lights thereon as illustrated in FIG. 17. As illustrated in FIG. 17, a pair of traffic control elements TCE and TCE' are stacked in a nesting relationship with each having a pair of warning lights WL secured thereto. The extent to which the second traffic element TCE' will nest with the first element TCE is dependent upon the distance the warning lights WL extend above the top surface of the element TCE. As noted in FIG. 17, the lights WL engage the bottom side of the top surface TCT and thereby arrest the downward travel of the second traffic element TCE'. The bottom of the arcuate section 10 for the element TCE' then terminates at the upper edge of the arcuate section 10 for the element TCE.

It has been determined that the most economical method of manufacturing the traffic control element TC is by constructing it of a preselected plastic by conventional molding techniques. The traffic control element TC is preferably constructed of a lightweight plastic and, in particular, a low density, linear polyethylene material. A specific grade of polyethylene should be selected that has the required structural integrity at both high and low temperatures to be maintained in an upright position and is resilient enough not to be damaged as a result of minor impacts so that the device TC can be reusable. It has been determined that the preferable molding techniques for manufacturing the traffic control element TC is to mold the body portion TCE by conventional blow molding apparatus, and the base element TCB by conventional injection molding apparatus. The tooling for each of these apparatus is constructed to define the configurations described hereinabove for the elements TCE and TCB. Accordingly, the body portion TCE of the traffic control element TC is defined by a suitable tooling for a blow molding operation.

The base element TCB has been constructed and defined of a resilient plastic material and it is preferably constructed by conventional injecting molding techniques. The resilient plastic selected for the base element TCB may be any one of the presently known plastics but preferably is one that is crush resistant to the extent that, when the base element TCB is separated from the top element TCE as a result of an impact by a motor vehicle and the motor vehicle travels over the base element TCB, it will not normally be crushed and rendered unusable. Accordingly, the plastic should be sufficiently resilient and yet have sufficient memory to regain its original condition before it was subjected to the weight of a motor vehicle or the like running over it.

One Piece Traffic Control Element

Figure 11:
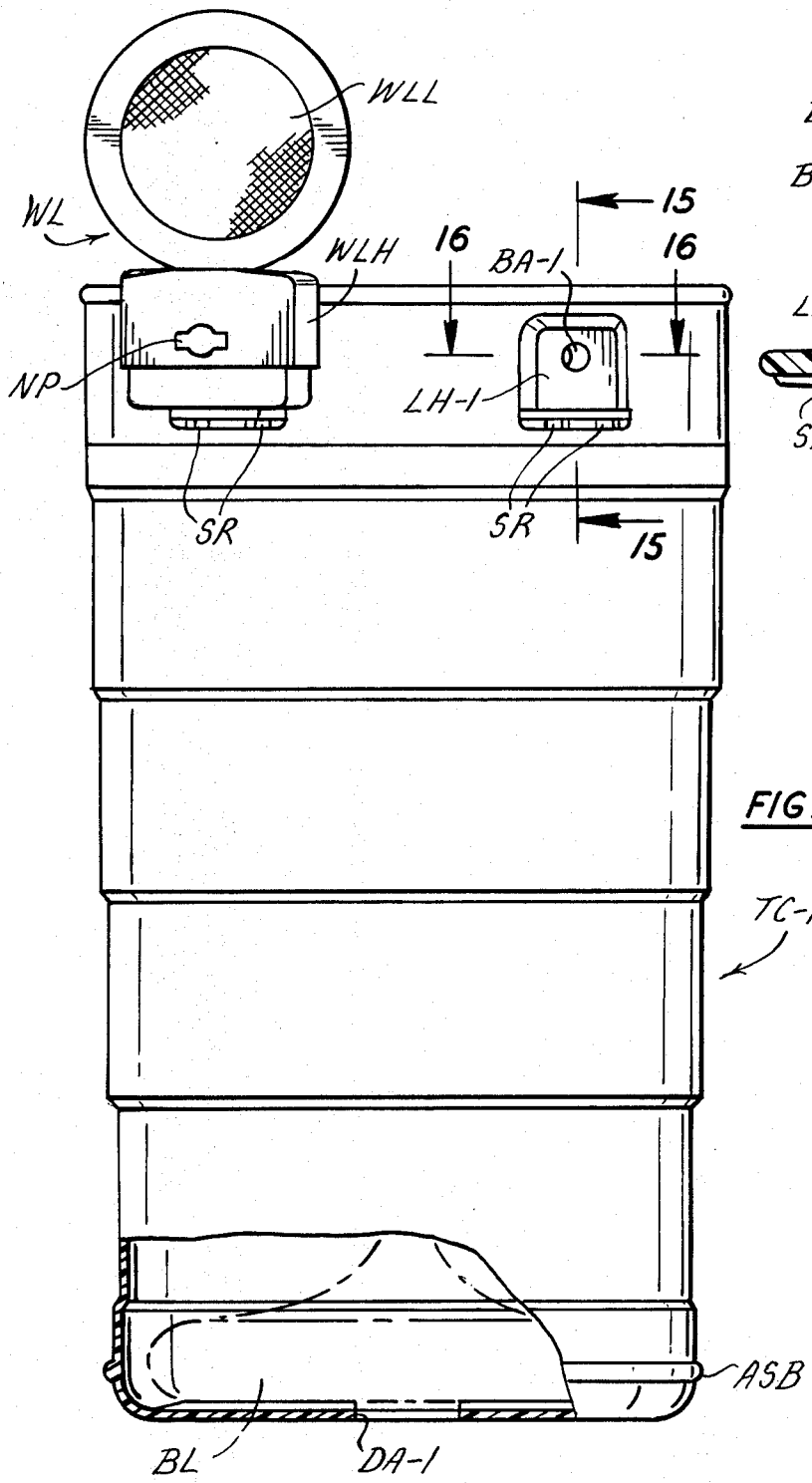
FIG. 11 is a rear elevational view of a one-piece traffic control device, with portions broken away, and with the stored ballast means illustrated in dotted outline and embodying the present invention.

With particular reference to FIGS. 11, through 16 and 18, the construction of the preferred embodiment of a one piece traffic control element TC-1 will now be described. The one piece traffic control element TC-1 has the same general configuration and overall dimensions as the channelizer TC. The traffic control element TC-1 is also constructed in a stepped configuration so as to permit a plurality of elements TC-1 to be stacked in a nesting relationship. Unlike the taper provided for the top element TCE for the element TC, the taper for the element TC-1 is such that the smallest end of the traffic control element is at the bottom or the end that rests on the supporting surface or ground, with the wider portion at the top, rather than having the wider portion at the bottom as element TCE is constructed. Reflective sheeting can be secured to the element TC-1 as described for the element TC. The element TC-1 is preferably manufactured from plastics having the same properties as for the element TCE by conventional blow molding techniques for economical manufacture of the traffic control element TC-1. For this purpose the bottom of the element TC-1 is closed, except for the drain hole DA-1 defined at the bottom of the element. The top portion of the element is open, as can be appreciated from examining FIG. 12. The overall configuration for the element TC-1 has an arcuate configuration that approaches that of a cylinder with one flat side FS-1 to render it roll resistant for the purposes described hereinabove for the device TC.

The dependent elements for the bottom of the traffic device TC-1 are defined as the plurality of ribs DR that extend radially outwardly from the drain aperture DA-1 to adjacent the outer periphery of the element as best illustrated in FIGS. 12 and 13. The elements DR preferably have a V cross-sectional configuration, as illustrated in FIG. 14, for engaging the channelizer supporting surface. The ballast means BL is stored on the inside surface of the bottom of the element TC-1 and has its weight distributed over the dependent ribs DR, as for the two piece embodiment. It is considered that the improvement for this embodiment by the use of the ribs DR increases the unit pressure approximately six times that of the smooth, flat bottom so as to avoid the slipping of the traffic control element TC-1 under the conditions of wind and vibration, as described hereinabove.

The other aspect of the construction and method of manufacturing the one piece channelizer TC-1 is the provision of the light holders LH-1 for mounting the warning lights WL thereto. The light holders LH-1 are constructed as L-shaped elements of a pliable plastic material. In this instance, the elements LH-1 are constructed and defined by conventional injection molding techniques prior to the construction of the channelizer TC-1 by blow molding techniques. The light holders LH-1 are constructed to have an L-shaped configuration, best illustrated in FIGS. 11 and 15, with an aperture BA-1 for receiving the mounting bolt B for the warning light WL for securing the warning light thereto. Once the light holders LH-1 are constructed by the injection molding process they are introduced into the blow molding apparatus at a location corresponding to their final location on the one piece channelizer TC-1 adjacent the top surface thereof, as illustrated in FIG. 11. The element TC-1 is constructed with a pair of bolt mounting apertures BA-1P defined in the wall thereof of the channelizer TC-1 to be coaxial with the apertures BA-1 for the light holders LH-1. The integration of the light holders LH-1 and the adjacent 35 wall of the traffic control element TC-1 includes the provision of a peripheral protrusion or securing knob LHP defined on the inside wall of the light holders LH-1 and extending completely around the periphery of the inside wall and is identified as LHP in FIGS. 15 and 16 to function as a locking element with the adjacent wall of the channelizer TC-1. For this purpose plastic is blow molded around the locking protrusions LHP of the light holders LH-1 so as to form an interlocking arrangement with the injection molded piece and to thereby permanently fuse the two elements securely together. The apertures BA-1 of the light holders LH-1 for receiving the warning light bolt B is reinforced by means of a reinforcing ring RR surrounding the aperture BA-1 on the inside wall and by means of the plastic material P defining the channelizer body that is introduced inside the aperture BA-1 during the blow molding procedure. In this fashion the amount of plastic surrounding a securing bolt B is increased and thereby reinforces the engagement between the bolt and the channelizer TC-1 to better allow the channelizer to withstand the impacts tending to cause the warning light mounted thereto from ripping through the plastic for the channelizer.

Figure 15:
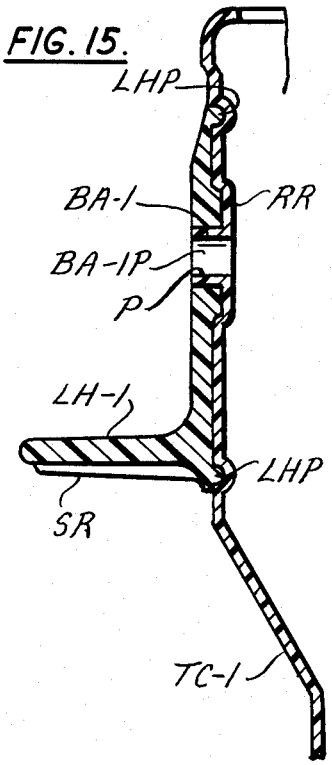
FIG. 15 is a partial sectional view taken along the line 15—15 of FIG. 11.

The horizontal arm of the L-shaped light holders LH-1 are reinforced by a pair of strengthening ribs SR arranged on the bottom side of the arm in a spaced-apart relationship; see FIGS. 11 and 15. These ribs SR are to permit the holders LH-1 to improve the non-rotatable properties of the holders.

As can best be appreciated from examining FIG. 12, the pair of light holders LH-1 are secured to the channelizer TC-1 on the flat side FS-1 and adjacent the top thereof at an angular relationship to the longitudinal centerline of the channelizer. This arrangement also enhances the roll resistant characteristic of the element TC-1. The warning light WL may be mounted to the completed channelizer TC-1 by resting the battery case WLH on the horizontal portion of the light holder LH-1 and securing the warning light WL thereto by securing the anti-theft bolt B to the nut plate NP of the warning light in the same manner as described hereinabove; see FIG. 11.

The warning lights WL that are commercially available permit the warning light lens WLL to be rotated relative to the housing WLH. As in the two-piece device, the traffic element TC-1 is preferably mounted for controlling traffic by exposing the arcuate or substantially cylindrical portion of the device to the oncoming traffic, as indicated by the legend in FIG. 12. The lens WLL of the warning light WL, as normally mounted on the light holder LH-1, would be angularly related to the longitudinal axis of the device TC-1 and thereby the oncoming traffic. To position the lens WLL in longitudinal alighnment with the oncoming traffic it can be rotated to that position to concentrate the light along the longitudinal axis of the element TC-1, as illustrated in FIG. 12. It should also be noted that with the preferred orientation of the device TC-1, illustrated in FIG. 12, the warning lights WL are arranged away from the oncoming traffic and minimize the likelihood of impact between the lights and a motor vehicle in a safer manner than the devices having the lights and holders exposed to the traffic.

The devices TC-1 can be stacked in a nesting relationship and including when the warning lights WL are mounted thereto, as illustrated in FIG. 18. As illustrated, a pair of elements TC-1 and TC-1′ are stacked in a nesting relationship to the extent that the element TC-1′ extends into the element TC being governed by the engagement of the warning light WL for the element TC-1 with the bottom of the light holder LH-1′ for the element TC-1′. When the elements TC-1 are stacked without the secured warning lights WL the elements TC-1′ would extend into the element TC-1 to a greater extent than illustrated in FIG. 18.

For the purpose of stacking the channelizers TC-1 are provided with an anti-sticking bead ASB adjacent the bottoms of the elements TC-1; see FIGS. 11 and 18. The anti-sticking bead ASB is provided to prevent the sticking of the channelizers to one another, such as when ten to twelve channelizers are stacked. Under these stacking conditions, the bead ASB defined on the element TC-1′ (see FIG. 12) will control the depth to which the second channelizer TC-1′ is inserted into the element TC-1.

I claim:

1. A traffic control element comprising a molded, plastic, hollow element having a preselected configuration and a molded, plastic bse element adapted to be readily assembled and separated from the hollow element, the hollow element being mounted to the base element when it is arranged in a vertical traffic controlling position, the base element being adapted to store ballast means thereon for stabilizing the hollow element when the hollow element is arranged in said vertical position, the improvement comprising the base element having outwardly extending skid means integrally constructed therewith along one side thereof for permitting the assembled traffic control element to be slid across a surface on the skid means when the skid means are positioned into engagement with a surface and so defined to prevent the hollow element and the base element to become unintentionally separated during the sliding on the skid means.

2. A traffic control element as defined in claim 1 wherein said skid means comprises a skid element extending outwardly of the outer periphery of the base element and constructed and defined with a curved skid surface extending along a surface thereof.

3. A traffic control element as defined in claim 1 wherein the hollow element includes a handle adjacent the top thereof for facilitating the movement of the assembled traffic control element including tilting of the hollow element for sliding it along a surface on the skid means.

4. A traffic control element as defined in claim 1 or 3 wherein the skid means is constructed and defined with an arcuate surface that is spaced from the supporting surface when the traffic control element is arranged in said traffic controlling position.

5. A traffic control element comprising a hollow element havinga preselected configuration, and a base element adapted to be readily assembled and separated from the hollow element, the hollow element being mounted to the base element when it is arranged in a vertical traffic controlling position, the base element being adapted to store ballast means thereon for stabilizing the assembly of th®hollow and base elements, the outside surface of the base element being constructed and defined with a multiplicity of dependent elements arranged on said surface whereby the traffic control element engages a mounting surface by means of said dependent elements, said dependent elements further functioning for distributing the weightof any ballast means stored on the base element over each of the multiplicity of dependent elements to cause the elements to function as localized pressure points on said mounting surface, at least a portion of the outside surface of the base element including outwardly extending skid means integrally arranged thereon along one side thereof and adjacent the outer periphery of the base element, the skid means being constructed and defined to provide a bearing surface for permitting the assembled hollow and base elements to be slid across the mounting surface when the skid means are positioned on the mounting surface without causing the hollow element, base element and any stabilizing element to become unintentionally separated during the sliding on the skid means along the mounting surface.

6. A traffic control element as defined in claim 5 wherein said multiplicity of dependent elements are arranged in a preselected regular pattern.

7. A traffic control element as defined in claim 5 wherein the hollow element and base element each have a preselected configuration with at least one flat side so that when the flat side of the hollow element is arranged in a vertical position it will prevent the element from readily rolling when impacted to a horzontal position.

8. A traffic control element as defined in claim 5 wherein the hollow element is constructed and defined with a preselected outer configuration to be roll resistant.

9. A traffic control element as defined in claim 5 wherein the hollow element and base element are molded of a resilient plastic.

10. A traffic control element as defined in claim 5 wherein the hollow element is a plastic molded element.

11. A traffic control element as defined in claim 5 wherein the hollow element is a plastic molded element produced by conventional plastic blow molding techniques.

12. A traffic control element as defined in claim 5 wherein said base element is a plastic molded element produced by conventional injection molding techniques.

13. A traffic control element as defined in claim 5 wherein the hollow element has an outer configuration that is constructed and defined to be of a stepped configuration from one end to the opposite end thereof to thereby allow a plurality of the hollow elements to be stacked in a nesting relationship when the hollow elements are disassembled from their base elements.

14. A traffic control element as defined in claim 13 wherein one end of said hollow element includes means for mounting a warning light to the element.

15. A traffic control element as defined in claim 14 wherein said mounting means comprises a plurality of means constructed and defined for mounting a plurality of warning lights to the element in a spaced apart relationship adjacent the outer periphery of the element.

16. A traffic control element as defined in claim 14 wherein said warning light mounting means is constructed and defined as a substantially L-shaped upstanding member for receiving and securing a warning light thereto.

17. A traffic control element as defined in claim 5 wherein said skid means comprises a skid extension constructed and defined integrally with the base element to extend outwardly of the periphery of the assembled hollow and base elements a preselected distance, an arcuate edge of extension functioning as a skid surface when said assembled elements are tilted to place the skid surface into engagement with the mounting surface.

18. A traffic control element as defined in claim 17 wherein the hollow element has a substantially closed top and includes a handle constructed and defined adjacent the top thereof for facilitating the movement of the assembled traffic control element including the tilting of the traffic control element for positioning the skid surface into engagement with the mounting surface to permit the traffic control element to be slid along the mounting surface by means of the skid surface when in the tilted position.

19. A traffic control element as defined in claim 17 wherein one end of the hollow element is constructed and defined to be substantially closed and includes upstanding means for mounting and securing a warning light to the hollow element.

20. A traffic control element as defined in claim 17 wherein one end of the hollow element is constructed and defined to be closed and includes a pair of spaced means integral with the closed end adapted to mount and secure a warning light to each of said means, said means being further defined with a handle between said spaced means and integral therewith.

21. A traffic control element as defined in claim 20 wherein the end of the hollow element opposite said one end is constructd and defined with an inwardly extending lip for engagement and disengagement with the base element, and the base element including a locking element defined in a complimentary configuration for locking and unlocking coaction with said lip to permit the hollow and base elements to be readily assembled together by means of the lip and locking element and to be readily separated from one another upon being impacted.

22. A traffic control element as defined in claim 17 wherein the hollow element has an outer configuration that is constructed and defined to be of a stepped configuration from one end to the opposite end thereof to thereby allow a plurality of the hollow elements to be stacked in a nesting relationship when the hollow elements are disassembled from their base elements.

23. A traffic control element as defined in claim 22 wherein one end of said hollow element includes means for mounting a warning light to the element.

24. A traffic control element as defined in claim 23 wherein said mounting means comprises a plurality of means constructed and defined for mounting a plurality of warning lights to the element in a spaced apart relationship adjacent the outer periphery of the element.

25. A traffic control element as defined in claim 24 wherein the hollow element has a substantially closed top and includes a handle constructed and defined adjacent the top thereof for facilitating the movement of the assembled traffic control element including the tilting of the traffic control element for positioning the skid surface into engagement with the mounting surface to permit the traffic control element to be slid along the mounting surface by means of the skid surface when in the tilted position.

26. A base element for a two piece traffic control element comprising a base element having a preselected configuration for storing ballast means, the base element having outwardly extending skid means constructed and defined thereon for permitting the two piece element to be slid across a supporting surface on the skid means when positioned against a supporting surface with the base element and the other piece of the element being detachably secured without causing the base element to become unintentionally detached as a result of sliding the securing elements along the supporting surface.

27. A base element as defined in claim 26 wherein the base element includes a multiplicity of dependent elements thereon spaced from said skid means for engaging a mounting surface by means of said dependent elements.

28. A base element for a two piece traffic control element as defined in claim 27 wherein the thus defined base element is molded from a crush resistant resilient plastic.

29. A two-piece traffic control element comprising a hollow element having a preselected outer configuration and a base element having a preselected outer configuration adapted to be releasably interlocked with said hollow element, said base element having a preselected configuration for storing ballast means thereon, the base element having a slip-resistant ground engaging surface arranged thereon for engaging a mounting surface in a slip-resistant fashion and outwardly extending skid means constructed and defined along one side of the base element to extend outwardly thereof including when the base element and said hollow element are releasably interlocked, said skid means having an arcuate skidding surface along one edge thereof for engaging the mounting surface when the interlocked base and hollow elements are tilted to place the skidding surface into engagement with the mounting surface.

30. A two-piece traffic control element as defined in claim 29 wherein the hollow element is further defined with a locking lip of a preselected width extending inwardly of the hollow element, said base element further including locking means engageable an disengageable with said locking lip for defining the two-piece traffic control elements, said skid means including a locking tab arranged thereon, adjacent said locking means for maintaining the base and hollow elements interlocked when the the interlocked pieces are dragged along by means of said skiding surface.

31. A two piece traffic control element as defined in claim 29 wherein said skid means has a preselected width extending outwardly of the releasably interlocked base and hollow elements for further stabilizing said elements from overturning when subjected to winds.

32. A two-piece traffic control element as defined in claim 31 wherein said skid means includes a skid resistant surface engageable with a mounting surface.

33. A two-piece traffic control element as defined in claim 32 wherein said skid resistant surface comprises a multiplicity of dependent elements.

34. A two-piece traffic control element comprising a hollow element having a preselected outer configuration and a base element having a preselected outer configuration adapted to be releasably interlocked with said hollow element, said base element having a preselected configuration for storing ballast means thereon and skid means constructed and defined along one side of the base element to extend outwardly thereof including when the base element and said hollow element are releasably interlocked, said skid means having an arcuate skidding surface along one edge thereof for engaging the mounting surface when the interlocked base and hollow elements are tilted to place the skidding surface into engagement with the mounting surfaces.

35. A two piece traffic control element as defined in claim 34 wherein in the hollow element is further defined with a locking lip of a preselected width extending inwardly of the hollow element, said base element further including locking means engaging and disengaging with said locking lip for defining the two piece traffic control element, said skid means including a locking tab arranged thereon adjacent said locking means for maintaning the base and hollow elements interlocked when the interlocked pieces are dragged along by means of said skidding surface.

36. A two-piece traffic control element as defined in claim 34 wherein said skid means has a preselected width extending outwardly of the releasably interlocked base and hollow elements for further stabilizing said elements from overturning when subjected to winds.

37. A two piece traffic control element as defined in claim 36 wherein said skid means includes a skid resistant surface engageable with a mounting surface.

* * * * *